United States Patent [19]

Flowers et al.

[11] Patent Number: 4,932,100

[45] Date of Patent: Jun. 12, 1990

[54] ANTI-RATTLE WEDGE ASSEMBLY

[75] Inventors: Thomas A. Flowers, Royal Oak; Gary L. Schubring, New Baltimore; Theodore E. Elward, Fraser, all of Mich.

[73] Assignee: Emhart Industries, Inc., Hartford, Conn.

[21] Appl. No.: 420,799

[22] Filed: Oct. 12, 1989

[51] Int. Cl.[5] ..... E05F 5/06; E05F 5/00

[52] U.S. Cl. ..... 16/82; 16/85; 16/DIG. 6; 16/DIG. 10; 16/DIG. 17; 267/139; 292/341.12; 292/DIG. 73; 296/207

[58] Field of Search ..... 16/82, 85, 86 R, 86 B, 16/DIG. 6, DIG. 10, DIG. 17, DIG. 32, 1 R, 49; 292/DIG. 15, DIG. 19, DIG. 73, 341.12; 296/207; 49/462; 267/139

[56] References Cited

U.S. PATENT DOCUMENTS

| | | | |
|---|---|---|---|
| 891,625 | 6/1908 | Leger | 292/DIG. 73 |
| 1,890,275 | 12/1932 | Wirth | 16/DIG. 6 |
| 2,056,971 | 10/1936 | Logie et al. | 16/85 |
| 2,143,266 | 1/1939 | Grondahl | 16/DIG. 6 |
| 3,008,174 | 11/1961 | Schonitzer | 16/85 |

FOREIGN PATENT DOCUMENTS

| | | | |
|---|---|---|---|
| 916754 | 1/1963 | United Kingdom | 16/DIG. 6 |

*Primary Examiner*—Richard K. Seidel
*Assistant Examiner*—Edward A. Brown
*Attorney, Agent, or Firm*—Spencer T. Smith

[57] ABSTRACT

A wedge assembly to be secured to a vehicle door to prevent door rattling during vehicle operation. A slide element is captured by a base plate and stops are provided to prevent inadvertent disassembly.

3 Claims, 1 Drawing Sheet

ANTI-RATTLE WEDGE ASSEMBLY

The present invention relates to wedge assemblies which are used to reduce vehicle user squeak and rattle compliants due to door and door latching system vibrations.

Vehicle doors are conventionally pivotally mounted to a vehicle frame and latched closed. During operation, the doors may rattle and the generated stress tends to cause sheet metal fatigue at the hinge and latch locations. Cracking and stress marks may result with the likelihood of corrosion increasing. Wedge assemblies are intended to prevent door vibrations and to thereby protect the hinge and latch mechanisms from deterioration.

Wedge assemblies are subject to manipulation by the installer and are occasionally damaged prior to installation. It is accordingly an object of the present invention to provide a wedge assembly which is designed to prevent damage prior to installation.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
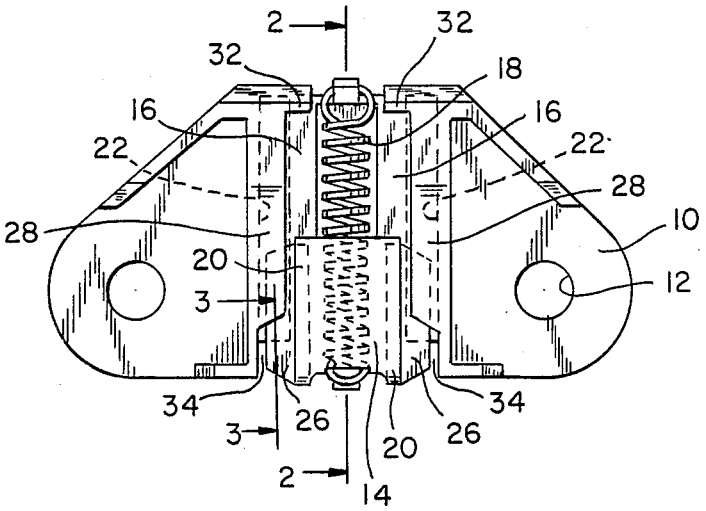
FIG. 1 is to top view of a wedge assembly made in accordance with the teachings of the present invention.

The wedge assembly has a base plate 10 which has a pair of holes 12 permitting connection by bolts or the like to the door of a vehicle. The base plate 10 supports a movable slide element 14 which is slideable along a pair of spaced parallel and inclined cam surfaces 16 defined on the base plate. The slide element is pulled toward its start position, at the left end of the cam surfaces in FIG. 2 by a spring element 18 and can be forced down the cam surfaces against the action of the spring by the vehicle surface which it strikes when the door is closed.

The slide eleent 14 is generally U-shaped (upside down) with the bottom surfaces 20 comprising the cam followers. Elongated slots 22 are defined in the base plate 10 in which stop elements 24 are located. These stop elements extend downwardly from flanges 26 that extend horizontally outwardly from the U-shaped body and are displaceable within the slots 22. The flanges 26 are trapped by overlying inwardly extending base plate flanges 28. Movement of the wedge element to the left (to the start position) is stopped by engagement of the rear vertical surfaces 30 of the wedge element with inwardly extending base plate projectories 32 and forward movement is limited by the engagement of each stop 24 with the portion 34 of the base plate at the forward end of its slot 22.

Figure 3:
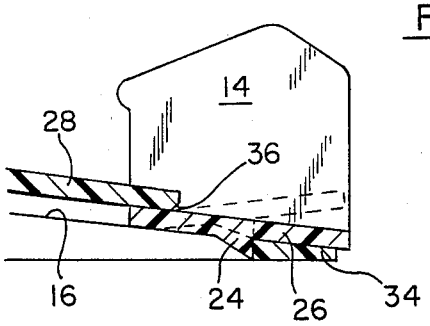
FIG. 3 is a view of the wedge assembly taken along lines 3—3 of FIG. 1.

To permit assembly, the overlying flanges 28 terminate short of the forward end of the slots and are beveled 36 inwardly along the lower front edge. As shown in FIG. 3 by the phantom lines; the slide element can be pivoted into its trapped operating location (the front portion of the overlying flanges 28 will b slightly deflected).

Figure 2:
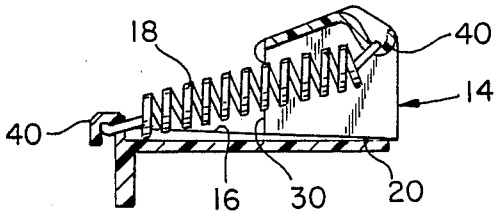
FIG. 2 is a view of the wedge assembly taken along lines 2—2 of FIG. 1.

As can be seen from FIG. 2, the ends of the spring are captured by J-shaped catches 40 which open in the direction opposite to the removal direction for the ends of the spring. These J-shaped hooks or catches minimize the likelihood that the spring can come off a result of snapping the wedge element.

We claim:

1. A wedge assembly comprising;

a base plate to be secured to the frame of a door including;

a pair of spaced parallel cam surfaces, a pair of spaced parallel slots situated outwardly of said cam surfaces, defined in a base portion of said base plate, said slots having forward and rearward ends and a pair of capturing flanges overlying said spaced parallel slots, a slide element to be displaced from a free state rearward location to a forward location including;

a pair of spaced parallel cam follower surfaces for engaging with the said cam surfaces, a pair of flanges, to be captured below said capturing flanges stop means projecting downwardly from said slide element flanges for location within said slots, said slots being selectively sized so that the displacement of said slide element towards said forward location will be stopped by engagement of said stop means and the forward end of said slots, and spring means interconnecting said base plate and said slide element for urging said slide element towards said rearward location.

2. A wedge assembly according to claim 1, wherein the ends of said base plate flanges proximate the forward ends of the slots terminate rearward therefrom to permit assembly of the wedge assembly.

3. A wedge assembly according to claim 2 wherein said base plate flange ends are beveled to facilitate assembly.

* * * * *